US010192482B2

(12) United States Patent
Cai et al.

(10) Patent No.: US 10,192,482 B2
(45) Date of Patent: Jan. 29, 2019

(54) PIXEL COMPENSATION CIRCUITS, SCANNING DRIVING CIRCUITS AND FLAT DISPLAY DEVICES

(71) Applicant: Shenzhen China Star Optoelectronics Technology Co., Ltd., Shenzhen, Guangdong (CN)

(72) Inventors: Yuying Cai, Guangdong (CN); Kaiyuan Ke, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 182 days.

(21) Appl. No.: 15/024,578

(22) PCT Filed: Feb. 25, 2016

(86) PCT No.: PCT/CN2016/074529

§ 371 (c)(1),
(2) Date: Mar. 24, 2016

(87) PCT Pub. No.: WO2017/128465

PCT Pub. Date: Aug. 3, 2017

(65) Prior Publication Data

US 2018/0040277 A1 Feb. 8, 2018

(30) Foreign Application Priority Data

Jan. 29, 2016 (CN) ..... 2016 1 0067868

(51) Int. Cl.

| | |
|---|---|
| ***G09G 3/3258*** | (2016.01) |
| ***G09G 3/3233*** | (2016.01) |
| ***G09G 3/3266*** | (2016.01) |
| ***G09G 3/3291*** | (2016.01) |
| *G09G 3/36* | (2006.01) |

(52) U.S. Cl.

CPC ..... *G09G 3/3258* (2013.01); *G09G 3/3233* (2013.01); *G09G 3/3266* (2013.01);
(Continued)

(58) Field of Classification Search

CPC .. G09G 3/3258; G09G 3/3291; G09G 3/3266; G09G 3/3677; G09G 3/3688;
(Continued)

(56) References Cited

U.S. PATENT DOCUMENTS

2005/0052377 A1* 3/2005 Hsueh ..... G09G 3/3233 345/82
2010/0141645 A1* 6/2010 Choi ..... G09G 3/3233 345/214

(Continued)

FOREIGN PATENT DOCUMENTS

| | | | |
|---|---|---|---|
| CN | 101859539 | A | 10/2010 |
| CN | 101980330 | A | 2/2011 |
| KR | 1020080048831 | A | 6/2008 |

*Primary Examiner* — Premal R Patel
(74) *Attorney, Agent, or Firm* — Andrew C. Cheng

(57) ABSTRACT

The present disclosure relates to a pixel compensation circuit, a scanning driving circuit and a flat display device. Control end of first controllable transistor connects to first scanning line, first end of first controllable transistor connects to data line; control end of driving transistor connects to second end of first controllable transistor, first end of driving transistor connects to first voltage end; control end of second controllable transistor connects to second scanning line, first end of second controllable transistor connects to second end of driving transistor; anode of OLED connects to second end of second controllable transistor, cathode of OLED is grounded; control end of driving transistor connects to first end of second controllable transistor through first capacitor, first end of second controllable transistor connects to second voltage end through second capacitor.

5 Claims, 4 Drawing Sheets

(52) U.S. Cl.
CPC ..... *G09G 3/3291* (2013.01); *G09G 3/3677* (2013.01); *G09G 3/3688* (2013.01); *G09G 2300/0819* (2013.01); *G09G 2300/0842* (2013.01); *G09G 2300/0861* (2013.01); *G09G 2310/0283* (2013.01); *G09G 2310/08* (2013.01)

(58) Field of Classification Search
CPC ..... G09G 2310/08; G09G 3/3233; G09G 2320/0233; G09G 3/325; G09G 3/3283; G09G 3/2003; G09G 2320/045
See application file for complete search history.

(56) References Cited

U.S. PATENT DOCUMENTS

2011/0096255 A1* 4/2011 Rho ..... C09K 19/0275 349/33
2011/0141165 A1 6/2011 Matsui et al.
2011/0221333 A1* 9/2011 Kim ..... H01L 51/524 313/504
2012/0062618 A1* 3/2012 Ono ..... G09G 3/3233 345/690
2012/0105421 A1 5/2012 Tsai et al.
2012/0200611 A1* 8/2012 Matsui ..... G09G 3/3233 345/690
2015/0077414 A1* 3/2015 Yoo ..... G09G 3/3275 345/212
2015/0170572 A1 6/2015 Qing et al.
2015/0220201 A1* 8/2015 Wu ..... G06F 3/0412 345/173
2015/0243220 A1* 8/2015 Kim ..... H01L 27/1225 345/215
2015/0348464 A1* 12/2015 In ..... G09G 3/2022 345/205
2016/0247449 A1* 8/2016 Yin ..... G09G 3/3233
2016/0365031 A1* 12/2016 Wu ..... G09G 3/3258
2017/0018229 A1* 1/2017 Zhang ..... G09G 3/3233
2017/0162122 A1* 6/2017 In ..... G09G 3/3266

* cited by examiner

PIXEL COMPENSATION CIRCUITS, SCANNING DRIVING CIRCUITS AND FLAT DISPLAY DEVICES

BACKGROUND OF THE INVENTION

1. Field of the Invention

The present disclosure relates to display technology, and more particularly to a pixel compensation circuit, a scanning driving circuit, and a flat display device.

2. Discussion of the Related Art

Organic light emitting diode (OLED) displays are characterized by attributes such as small dimensional, simple structure, emitting light itself, large viewing angle, and short response time, and thus have drew a great deal attentions. The voltage signals outputted by the first voltage end and the data voltage signals outputted from the data line of the OLED display are complex, and may cause adverse impact toward the circuit operations.

SUMMARY

The present disclosure relates to a pixel compensation circuit, a scanning driving circuit and a flat display device to reduce the complexity of the voltage signals outputted by the first voltage end and the data voltage signals outputted from the data line of the OLED display so as to facilitate the operations of the circuit.

In one aspect, a pixel compensation circuit includes: a first controllable transistor having a control end, a first end, and a second end, the control end of the first controllable transistor connects to a first scanning line, and the first end of the first controllable transistor connects to one data line to receive a data voltage via the data line; a driving transistor having a control end, a first end, and a second end, the control end of the driving transistor connects to the second end of the first controllable transistor, and the first end of the driving transistor connects to a first voltage end; a second controllable transistor having a control end, a first end, and a second end, the control end of the second controllable transistor connects to a second scanning line, and the first end of the second controllable transistor connects to the second end of the driving transistor; an OLED having an anode and a cathode, the anode of the OLED connects to the second end of the second controllable transistor, and the cathode of the OLED is grounded; a first capacitor having a first end and a second end, the first end of the first capacitor connects to the control end of the driving transistor, and the second end of the first capacitor connects to the first end of the second controllable transistor; and a second capacitor includes a first end and a second end, the first end of the second capacitor connects to the first end of the second controllable transistor and the second end of the first capacitor, and the second end of the second capacitor connects to a second voltage end.

Wherein the driving transistor, the first controllable transistor, and the second controllable transistor are NMOS TFTs, or PMOS TFTs, or a combination of NMOS TFTs and PMOS TFTs, and the control end, the first end, and the second end of the driving transistor, the first controllable transistor, and the second controllable transistor respectively correspond to a gate, a drain, and a source of a TFT.

In one aspect, a scanning driving circuit includes a pixel compensation circuit, and the pixel compensation circuit includes: a first controllable transistor having a control end, a first end, and a second end, the control end of the first controllable transistor connects to a first scanning line, and the first end of the first controllable transistor connects to one data line to receive a data voltage via the data line; a driving transistor having a control end, a first end, and a second end, the control end of the driving transistor connects to the second end of the first controllable transistor, and the first end of the driving transistor connects to a first voltage end; a second controllable transistor having a control end, a first end, and a second end, the control end of the second controllable transistor connects to a second scanning line, and the first end of the second controllable transistor connects to the second end of the driving transistor; an OLED having an anode and a cathode, the anode of the OLED connects to the second end of the second controllable transistor, and the cathode of the OLED is grounded; a first capacitor having a first end and a second end, the first end of the first capacitor connects to the control end of the driving transistor, and the second end of the first capacitor connects to the first end of the second controllable transistor; and a second capacitor includes a first end and a second end, the first end of the second capacitor connects to the first end of the second controllable transistor and the second end of the first capacitor, and the second end of the second capacitor connects to a second voltage end.

Wherein the driving transistor, the first controllable transistor, and the second controllable transistor are NMOS TFTs, or PMOS TFTs, or a combination of NMOS TFTs and PMOS TFTs, and the control end, the first end, and the second end of the driving transistor, the first controllable transistor, and the second controllable transistor respectively correspond to a gate, a drain, and a source of a TFT.

In another aspect, a flat display device includes a pixel compensation circuit, and the pixel compensation circuit includes: a first controllable transistor having a control end, a first end, and a second end, the control end of the first controllable transistor connects to a first scanning line, and the first end of the first controllable transistor connects to one data line to receive a data voltage via the data line; a driving transistor having a control end, a first end, and a second end, the control end of the driving transistor connects to the second end of the first controllable transistor, and the first end of the driving transistor connects to a first voltage end; a second controllable transistor having a control end, a first end, and a second end, the control end of the second controllable transistor connects to a second scanning line, and the first end of the second controllable transistor connects to the second end of the driving transistor; an OLED having an anode and a cathode, the anode of the OLED connects to the second end of the second controllable transistor, and the cathode of the OLED is grounded; a first capacitor having a first end and a second end, the first end of the first capacitor connects to the control end of the driving transistor, and the second end of the first capacitor connects to the first end of the second controllable transistor; and a second capacitor includes a first end and a second end, the first end of the second capacitor connects to the first end of the second controllable transistor and the second end of the first capacitor, and the second end of the second capacitor connects to a second voltage end.

Wherein the driving transistor, the first controllable transistor, and the second controllable transistor are NMOS TFTs, or PMOS TFTs, or a combination of NMOS TFTs and PMOS TFTs, and the control end, the first end, and the second end of the driving transistor, the first controllable transistor, and the second controllable transistor respectively correspond to a gate, a drain, and a source of a TFT.

Wherein the flat display device is an OLED or LCD.

In view of the above, the pixel compensation circuit adopts the second controllable transistor (T2), the second capacitor (C2), and the second voltage end to reduce the complexity of the first voltage signals outputted by the first voltage end and the data voltage signals outputted from the data line so as to facilitate the operations of the circuit.

DETAILED DESCRIPTION OF THE EMBODIMENTS

Embodiments of the invention will now be described more fully hereinafter with reference to the accompanying drawings, in which embodiments of the invention are shown.

Figure 1:
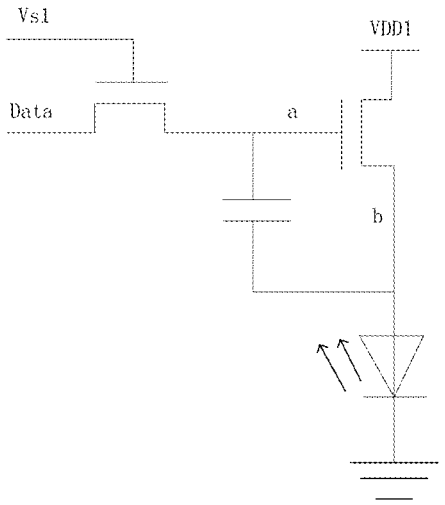
FIG 1 (Prior Art)
FIG. 1 is a schematic view of one conventional pixel compensation circuit.
Figure 2:
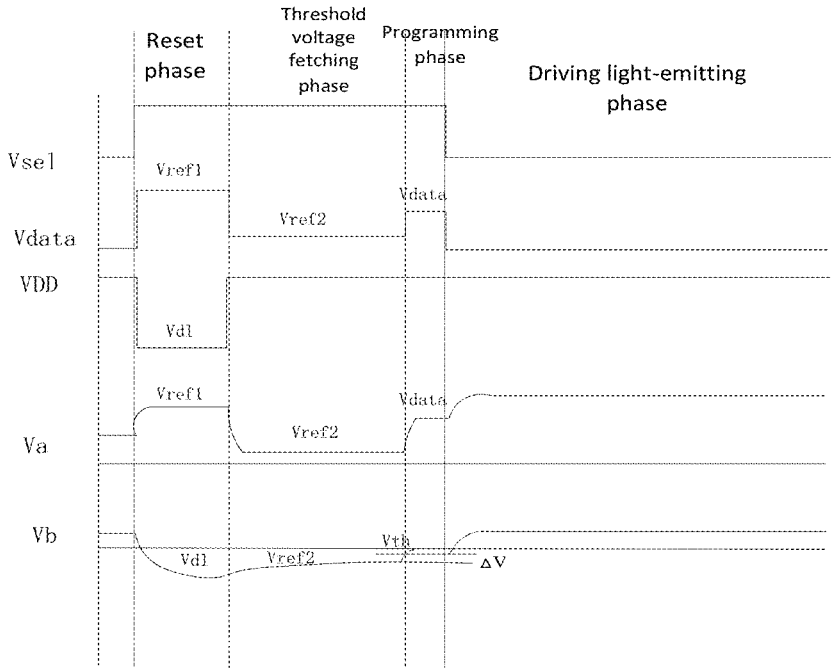
FIG 2 (Prior Art)
FIG. 2 is a waveform diagram of one conventional pixel compensation circuit.
Figure 3:
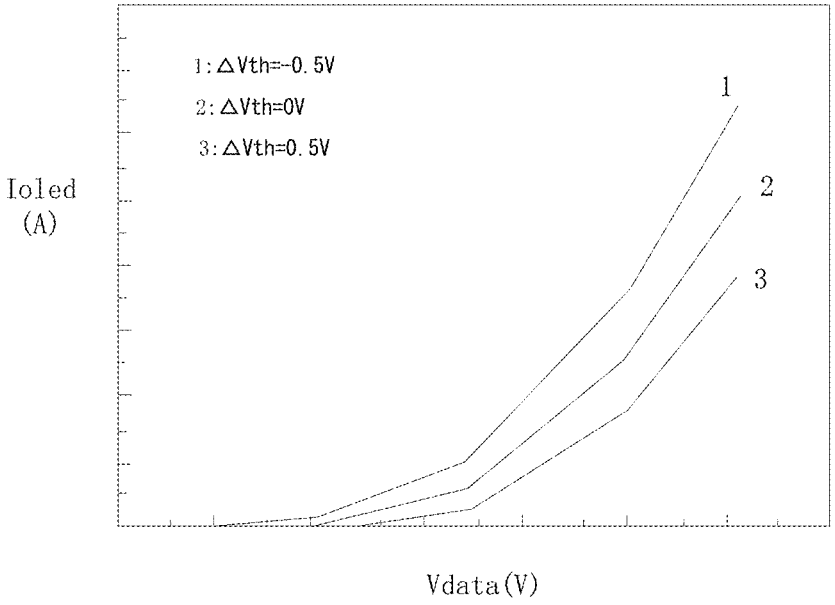
FIG 3 (Prior Art)
FIG. 3 is a simulation diagram of one conventional pixel compensation circuit.

Referring to FIGS. 1-3, the conventional pixel compensation circuit includes two thin film transistors (TFTs) and one storage capacitor. During the compensation phase, the current of the pixel compensation circuit passes through the OLEDs. In view of FIG. 2, the voltage (VDD) signals outputted from the first voltage end of the pixel compensation circuit are complex and the signals are delayed. In addition, the data voltage (Vdata) may affect the voltage of second end of the driven transistor, and the data voltage (Vdata) signals are complex.

Figure 4:
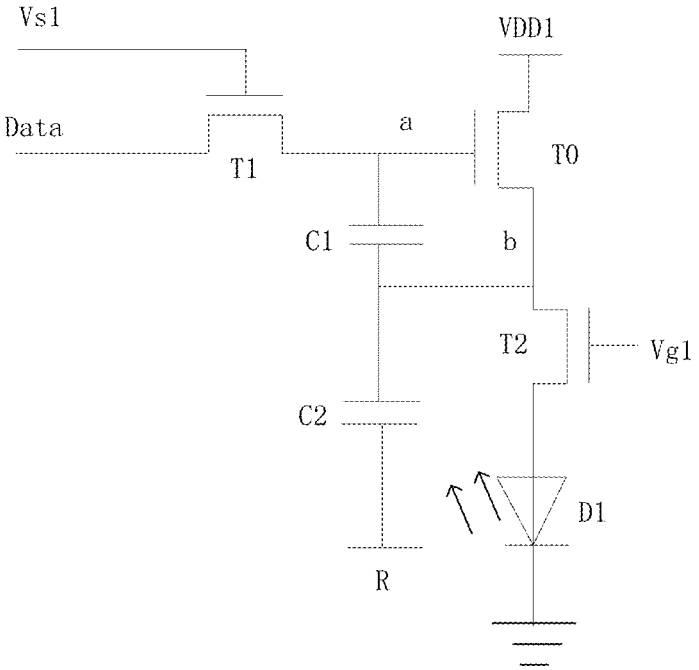
FIG. 4 is a schematic view of the pixel compensation circuit in accordance with one embodiment.

FIG. 4 is a schematic view of the pixel compensation circuit in accordance with one embodiment. As shown in FIG. 4, the controllable includes:

A first controllable transistor (T1) includes a control end, a first end, and a second end. The control end of the first controllable transistor (T1) connects to a first scanning line (Vsl), and the first end of the first controllable transistor (T1) connects to one data line (Data) such that the data line (Data) receives the data voltage (Vdata);

A driving transistor (T0) includes a control end, a first end, and a second end. The control end of the driving transistor (T0) connects to the second end of the first controllable transistor (T1), and the first end of the driving transistor (T0) connects to the first voltage end (VDD1);

A second controllable transistor (T2) includes a control end, a first end, and a second end. The control end of the second controllable transistor (T2) connects to a second scanning line (Vg1), and the first end of the second controllable transistor (T2) connects to the second end of the driving transistor (T0);

An OLED (D1) having an anode and a cathode. The anode of the OLED (D1) connects to the second end of the second controllable transistor (T2), and the cathode of the OLED (D1) is grounded;

A first capacitor (C1) includes a first end and a second end. The first end of the first capacitor (C1) connects to the control end of the driving transistor (T0), and the second end of the first capacitor (C1) connects to the first end of the second controllable transistor (T2); and A second capacitor (C2) includes a first end and a second end. The first end of the second capacitor (C2) connects to the first end of the second controllable transistor (T2) and the second end of the first capacitor (C1), and the second end of the second capacitor (C2) connects to a second voltage end (R).

In the embodiment, the driving transistor (T0), the first controllable transistor (T1), and the second controllable transistor (T2) are NMOS TFTs, or PMOS TFTs, or a combination of NMOS TFTs and PMOS TFTs. The control end, the first end, and the second end of the driving transistor (T0), the first controllable transistor (T1), and the second controllable transistor (T2) respectively correspond to a gate, a drain, and a source of the TFT.

Figure 5:
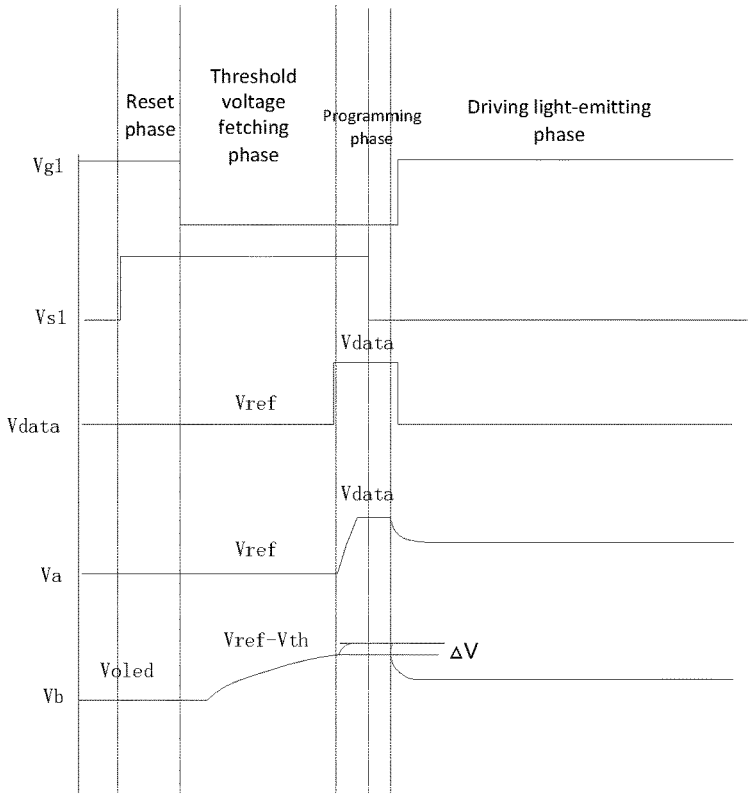
FIG. 5 is a waveform diagram of the pixel compensation circuit in accordance with one embodiment.
Figure 6:
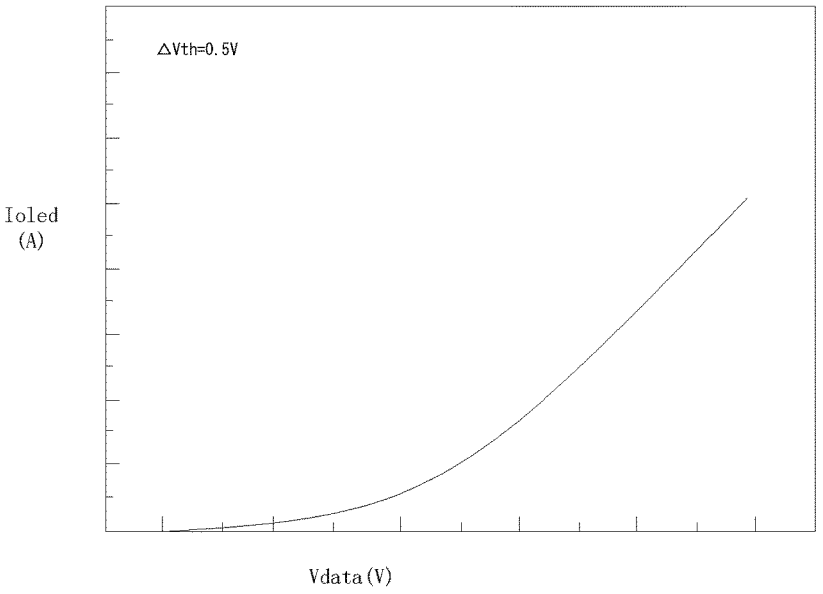
FIG. 6 is a simulation diagram of the pixel compensation circuit in accordance with one embodiment.

FIG. 5 is a waveform diagram of the pixel compensation circuit in accordance with one embodiment. FIG. 6 is a simulation diagram of the pixel compensation circuit in accordance with one embodiment. As shown, the second controllable transistor (T2) prevents the current from passing through the OLED (D1) during a compensation phase. In FIG. 4, it can be clear that the complexity of the first voltage (VDD) signals has been reduced, and the delay has also been decreased. In response to the control of the second capacitor (C2) and the second voltage end (R), the impact from the data voltage (Vdata) toward the voltage at two ends of the driving transistor (T0) has been reduced. In addition, it can be clearly seen that the complexity of the data voltage (Vdata) signals is also reduced in view of FIG. 4.

Figure 7:
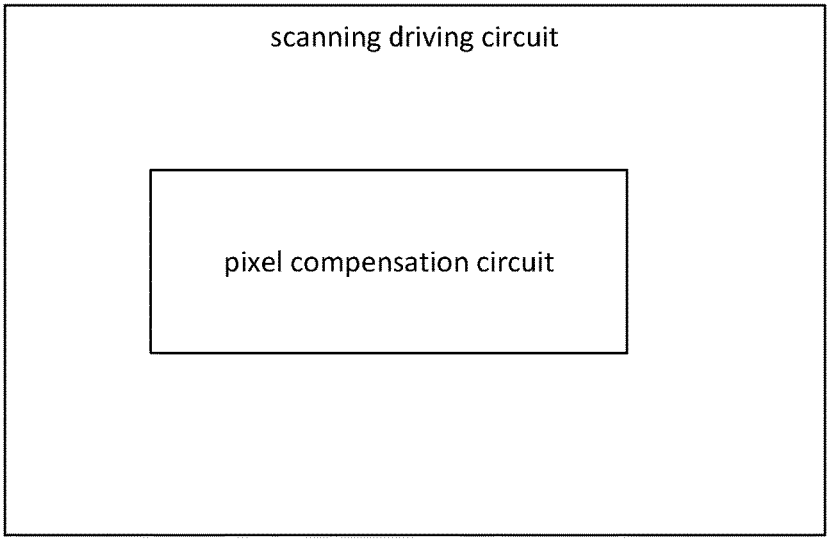
FIG. 7 is a schematic view of the scanning driving circuit in accordance with one embodiment.

FIG. 7 is a schematic view of the scanning driving circuit in accordance with one embodiment. The scanning driving circuit includes the above pixel compensation circuit for avoiding the threshold voltage drifting with respect to the driving transistor within the scanning driving circuit so as to avoid the non-uniform brightness of the panel.

Figure 8:
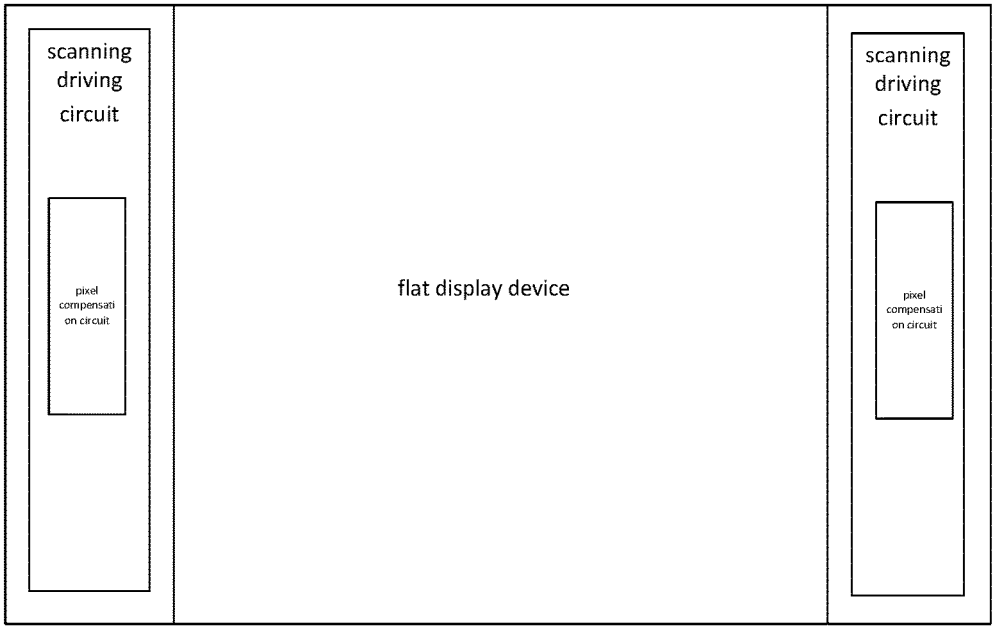
FIG. 8 is a schematic view of the flat display device in accordance with one embodiment.

FIG. 8 is a schematic view of the flat display device in accordance with one embodiment. The flat display device may be OLED or LCD including the above scanning driving circuit and the above pixel compensation circuit. The scanning driving circuit having the pixel compensation circuit is arranged in a rim of the flat display device. In an example, the scanning driving circuits are arranged at two ends of the flat display device.

The pixel compensation circuit adopts the second controllable transistor (T2), the second capacitor (C2), and the second voltage end to reduce the complexity of the first voltage signals outputted by the first voltage end and the data voltage signals outputted from the data line so as to facilitate the operations of the circuit.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A pixel compensation circuit, comprising:

a first controllable transistor having a control end, a first end, and a second end, the control end of the first controllable transistor connects to a first scanning line, and the first end of the first controllable transistor connects to one data line to receive a data voltage via the data line;

a driving transistor having a control end, a first end, and a second end, the control end of the driving transistor directly connects to the second end of the first controllable transistor, and the first end of the driving transistor connects to a first voltage end;

a second controllable transistor having a control end, a first end, and a second end, the control end of the second controllable transistor connects to a second scanning line, and the first end of the second controllable transistor connects to the second end of the driving transistor;

an OLED having an anode and a cathode, the anode of the OLED directly connects to the second end of the second controllable transistor, and the cathode of the OLED is grounded;

a first capacitor having a first end and a second end, the first end of the first capacitor connects to the control end of the driving transistor, and the second end of the first capacitor connects to the first end of the second controllable transistor; and a second capacitor includes a first end and a second end, the first end of the second capacitor connects to the first end of the second controllable transistor and the second end of the first capacitor, and the second end of the second capacitor connects to a second voltage end.

2. The pixel compensation circuit as claimed in claim 1, wherein the driving transistor, the first controllable transistor, and the second controllable transistor are NMOS TFTs, or PMOS TFTs, or a combination of NMOS TFTs and PMOS TFTs, and the control end, the first end, and the second end of the driving transistor, the first controllable transistor, and the second controllable transistor respectively correspond to a gate, a drain, and a source of a TFT.

3. A flat display device comprises a pixel compensation circuit, and the pixel compensation circuit comprising:

a first controllable transistor having a control end, a first end, and a second end, the control end of the first controllable transistor connects to a first scanning line, and the first end of the first controllable transistor connects to one data line to receive a data voltage via the data line;

a driving transistor having a control end, a first end, and a second end, the control end of the driving transistor directly connects to the second end of the first controllable transistor, and the first end of the driving transistor connects to a first voltage end;

a second controllable transistor having a control end, a first end, and a second end, the control end of the second controllable transistor connects to a second scanning line, and the first end of the second controllable transistor connects to the second end of the driving transistor;

an OLED having an anode and a cathode, the anode of the OLED directly connects to the second end of the second controllable transistor, and the cathode of the OLED is grounded;

a first capacitor having a first end and a second end, the first end of the first capacitor connects to the control end of the driving transistor, and the second end of the first capacitor connects to the first end of the second controllable transistor; and a second capacitor includes a first end and a second end, the first end of the second capacitor connects to the first end of the second controllable transistor and the second end of the first capacitor, and the second end of the second capacitor connects to a second voltage end.

4. The flat display device as claimed in claim 3, wherein the driving transistor, the first controllable transistor, and the second controllable transistor are NMOS TFTs, or PMOS TFTs, or a combination of NMOS TFTs and PMOS TFTs, and the control end, the first end, and the second end of the driving transistor, the first controllable transistor, and the second controllable transistor respectively correspond to a gate, a drain, and a source of a TFT.

5. The flat display device as claimed in claim 3, wherein the flat display device is an OLED or LCD.

* * * * *